US007757696B2

(12) United States Patent
Shaw et al.

(10) Patent No.: US 7,757,696 B2
(45) Date of Patent: Jul. 20, 2010

(54) CIGARETTE BUTT RECEPTACLE DEVICE

(76) Inventors: Mark D. Shaw, 132 Sea Lily La., Ponte Vedra Beach, FL (US) 32082; J. Tad Heyman, 659 Ocean Blvd., Atlantic Beach, FL (US) 32233; Laurence M. Bierce, 1215 Pine Cir., Macclenny, FL (US) 32063

( * ) Notice: Subject to any disclaimer, the term of this patent is extended or adjusted under 35 U.S.C. 154(b) by 1331 days.

(21) Appl. No.: 10/887,167

(22) Filed: Jul. 8, 2004

(65) Prior Publication Data

US 2005/0005945 A1 Jan. 13, 2005

Related U.S. Application Data

(60) Provisional application No. 60/485,936, filed on Jul. 8, 2003.

(51) Int. Cl.
*A24D 1/12* (2006.01)

(52) U.S. Cl. ..... 131/231; 131/235.1; 131/236; 131/241; 131/242; D27/119; D27/122; D27/109; D27/118; D27/107

(58) Field of Classification Search ..... 131/231
See application file for complete search history.

(56) References Cited

U.S. PATENT DOCUMENTS

| | | | | | |
|---|---|---|---|---|---|
| D82,959 | S | * | 12/1930 | Schwarz | D27/107 |
| 5,906,211 | A | * | 5/1999 | Mason | 131/256 |
| 6,186,355 | B1 | | 2/2001 | Luedecke | |
| D480,504 | S | * | 10/2003 | Taylor | D27/119 |

* cited by examiner

*Primary Examiner*—Philip C Tucker
*Assistant Examiner*—Phu H Nguyen
(74) *Attorney, Agent, or Firm*—Thomas C. Saitta

(57) ABSTRACT

An improved cigarette butt receptacle device for receiving cigarette butts, the device having a base retaining a container member, a receiving tube member with a chute segment directing the butts into the receptacle member and a secondary housing member that encloses the chute segment to alter the external visual appearance. In an alternate embodiment, the device has a cap member that joins to the chute segment. In an alternate embodiment the device has a non-linear chute member.

14 Claims, 3 Drawing Sheets

CIGARETTE BUTT RECEPTACLE DEVICE

This application claims the benefit of U.S. Provisional Patent Application Ser. No. 60/485,936, filed Jul. 8, 2003.

BACKGROUND OF THE INVENTION

This invention relates generally to the field of waste receptacle devices, and more particularly to the field of waste receptacle devices designed to receive cigarette butts, and even more particularly to such devices that are freestanding and primarily intended for placement outdoors.

Butt receptacle devices, also known as smokers' urns, have become very common as laws forbidding smoking within buildings have proliferated. The laws have resulted in the creation of designated smoking areas. Because cigarettes cannot be brought into buildings, accumulations of discarded butts at entrances and in the designated smoking areas quickly became a problem. To address this, butt receptacle devices are placed at the entrances and in the designated smoking areas. These devices share several common structural features in order to accomplish the primary function of the device—receiving, storing and snuffing large quantities of smoldering cigarette butts for later disposal. These common features consist of an open-topped butt-retaining container composed of a non-flammable and durable material, typically a metal bucket or can, a base to receive the container, and a relatively narrow, elongated, vertically-oriented receiving tube or chute, the receiving tube being provided with one or more small openings for insertion of the cigarette butts. The butt receiving openings are most preferably provided with a cap, cover, overhang or similar structural feature to preclude or limit entry of rain into the tube, or alternatively the butt receiving openings may be simply positioned on the vertical sides of the tube. In typical butt receptacle devices, the tube flares out at the bottom in a manner that allows it to mate with the base in a removable manner, such that the tube may be removed from the base in order to access the butt container for disposal of the butts.

The narrow receiving tube serves two purposes. The first purpose is to direct the falling cigarette butts into the open-topped container. The second purpose is to limit and restrict airflow into and out of the device such that any smoke or odor emanating from the smoldering butts is retained within the device and further such that the amount of oxygen within the device remains limited in order to more quickly snuff out the smoldering butts.

Most cigarette butt receptacle devices in production today are aesthetically limited, with the most common units consisting of a circular-in-cross-section base encasing the container bucket and a co-axially oriented, vertical, linear receiving tube disposed atop the base. Simple design elements, such as ridges or channels, are sometimes disposed either annularly or vertically on the base and tube in a weak attempt to better the visual appearance. These simple design elements do little to disguise or reduce the presence of the butt receptacles in the visual landscape, as the devices are readily identifiable. Given that the butt receptacles are usually disposed at exterior entryways into buildings, this common structure is the equivalent of placing garbage cans at the primary points of entry.

It is an object of this invention to provide cigarette butt receptacles of a structure and design that eliminates or at least dramatically reduces the aesthetic drawbacks of the typical structures by providing structure that presents less obtrusive visual impressions. It is a further object to provide cigarette butt receptacles wherein the functionality remains but is contained within external or additional structural components in order to alter the visual impression of the device, allowing the visual impressions to be readily changed if desired. It is further object to provide such devices where the additional structural components comprise for example exterior housings for the receiving tube or cap elements for the top of the tube. It is a further object to provide such devices wherein the additional structure comprises interchangeable elements such that a given butt receptacle device may have multiple appearances, and wherein particular messages may be conveyed to the public. It is a further object to provide such devices wherein the receiving tube or chute of the device is non-linear, such that it is curved or comprises angled segments, such that the upper portion of the tube does not need to be coaxially aligned with the butt receptacle, thereby allowing greater variety of engineering design. These objects, as well as objects not expressly set forth but which will become apparent upon examination of the disclosure to follow, are set forth expressly or implicitly below in detailed description.

SUMMARY OF THE INVENTION

In general, the invention is an improved or alternative construction for a cigarette butt receptacle device, wherein the butt receptacle device comprises in combination an open-topped, butt-receiving container member composed of a non-flammable and durable material, typically a metal bucket or can, a receptacle base member to receive the container therein, and a relatively narrow, elongated, vertically-oriented receiving tube or chute member that connects to and sits atop the base member, the receiving tube member being provided with one or more disposal openings for insertion of the cigarette butts. The receiving tube member is removable from the receptacle base member to provide access to the container member for disposal of the butts.

In a first embodiment, the invention comprises a secondary tube housing or shroud member that is disposed externally to and about the receiving tube, such that the external presentation of the receiving tube is hidden or altered. The secondary tube housing member may be permanently attached to the receiving tube member or may be temporarily connected, such that the secondary tube housing member may be interchanged with secondary tube housing members of different configuration, visual presentation or message as desired.

In a second embodiment, the invention comprises a cap member that mounts onto the upper end of the receiving tube in an interchangeable manner such that cap member may be interchanged with cap members of different configuration, visual presentation or message as desired. The cap member may or may not contain the butt disposal opening.

In a third embodiment, the invention comprises a non-linear receiving tube, such that the tube is completely or partially curved, or is comprised of linear segments joined at angles between 90 and 180 degrees.

In any of the embodiments, the invention may comprise a cigarette butt receptacle device having an external configuration that is shaped as a plant or shrub, or a physical object for advertising purposes, or any similar "deceptive" external configuration serving a dual purpose of providing a functioning cigarette butt receiving means and presenting a visual message.

DETAILED DESCRIPTION OF THE INVENTION

With reference to the drawings, the invention will now be described in detail with regard for the best modes and the preferred embodiments. In a most general sense, the invention is an improved cigarette butt receptacle device.

Figure 1:
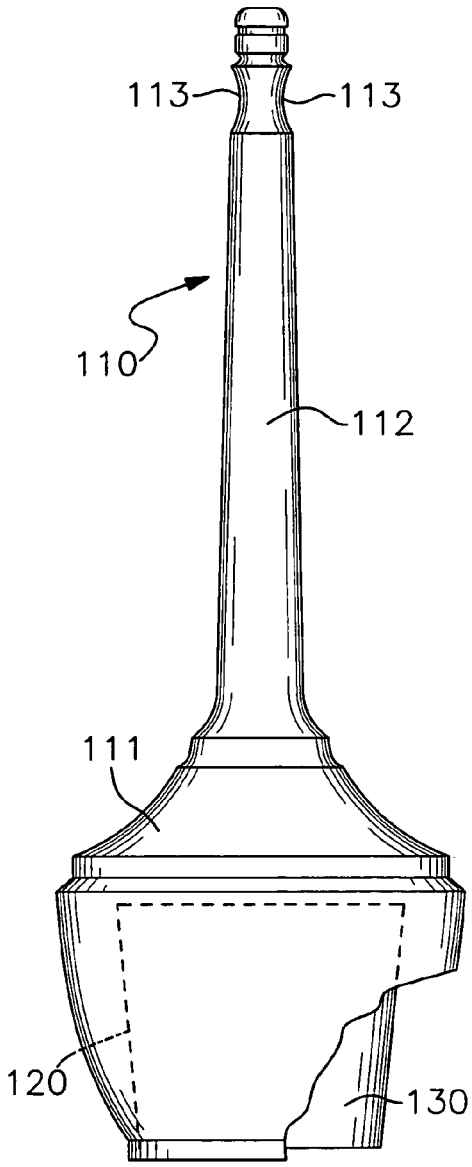
Fig. 1 Prior Art
FIG. 1 shows a representative prior art cigarette butt receptacle device of the traditional configuration, illustrating a receiving tube detachably mounted onto a base, with a portion of the base lateral wall removed to expose the internal butt container.

A typical or traditional cigarette butt receptacle device is shown in FIG. 1 to comprise a base member 120, a receiving tube member 110 and a butt container member 130. The container member 130 is an open-topped container composed of a non-flammable material, preferably metal, and is typically a bucket having a handle for ease of removal and handling. The butt container member 130 is retained within base member 120, which is likewise an open-topped member, and is typically a bottomed cylindrical member composed of a durable plastic. The receiving tube member 110 is detachably mounted atop the base member 120, typically with a mechanical interlock, friction fit or threading, and comprises a flared open bottom 111 sized to mate with the base member 120, an elongated, vertically-oriented chute segment 112 and one or more butt disposal openings 113, usually mounted on a side wall of the chute segment 112. When a butt is deposited into the butt disposal opening 113 of the receiving tube member 110, it falls through the chute segment 112 and is directed into the container member 130. To empty the device, the receiving tube member 110 is detached from the base member 120 and the container member 130 is lifted out.

Figure 2:
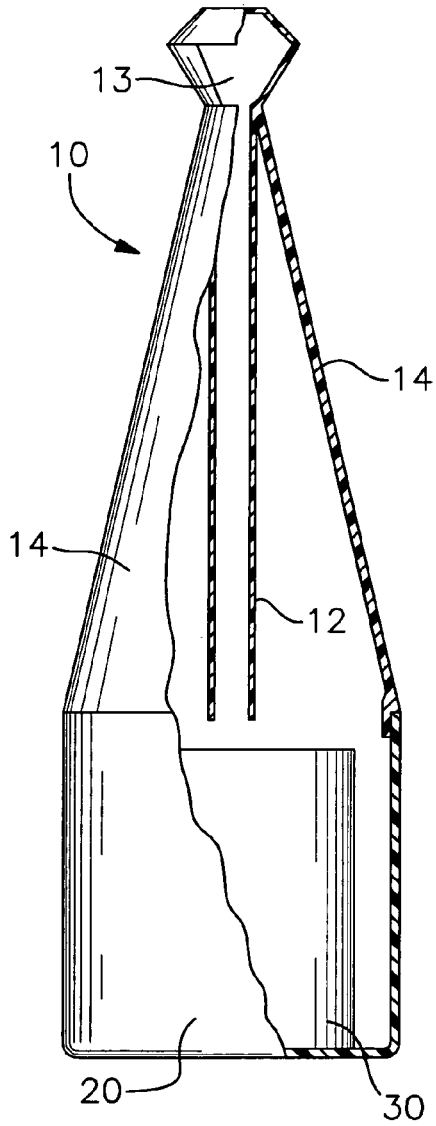
FIG. 2 shows a first embodiment of the invention, wherein a secondary housing or shroud member is disposed atop the base member to encircle the receiving tube member, the secondary housing member and the receiving tube member being formed as an integral component.

A first embodiment of an improved cigarette butt receptacle device, shown in FIG. 2, comprises a base member 20 and a container member 30 of generally standard configuration and construction, the base member 20 being a generally cylindrical, open-topped, closed-bottomed member having an interior space to receive the container member 30, with container member 30 being an open-topped, closed-bottomed container made of metal or other non-flammable material. The receiving tube member 10 is distinct from the traditional structure. The receiving tube member 10 is comprised of a relatively narrow, vertically oriented, tubular chute segment 12 and butt disposal openings 13 located at the upper end of the chute segment 12. The chute segment 12 functions to direct the disposed butts into the receptacle member 30 as well as to restrict air flow into and out of the interior of the device. The receiving tube member 10 is provided with a secondary housing or shroud member 14 that is attached to the upper end of the chute segment 12 below the disposal openings 13 and flares outwardly in a conical manner such that the bottom of the secondary housing member 14 mates with the open top of the base member 20. The mating shown in FIG. 2 is a friction or snap-fit mating, but equivalent connecting means such as mated threading or mechanical interlocks could also be employed. The presence of secondary housing member 14 dramatically alters the visual appearance of the device, provides a means to present decorative or advertising indicia, and also serves to trap smoke and odors rising from the cigarette butts within the interior of the secondary housing member 14 rather than allowing them to escape through the chute segment 12.

Figure 3:
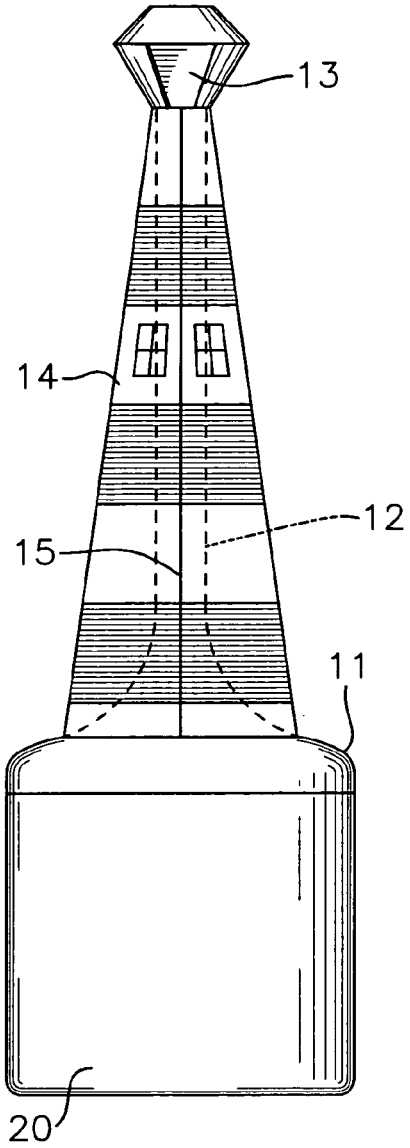
FIG. 3 shows a variation of the first embodiment wherein the secondary housing member is detachable from the receiving tube member.

A variation of this embodiment is shown in FIG. 3, wherein the secondary housing member 14 is formed separately and detachable from the receiving tube member 10, which is constructed in the traditional manner to have a flared bottom 11 mating in suitable manner with the top of the base member 20. The secondary housing 14 preferably sits atop the flared bottom 11 and may be formed from a sheet member that is wrapped around the chute segment 12, the sheet being joined at seam 15 by fastening means such as mechanical fasteners, tabs and slots, hook-and-loop fasteners, or the like. Alternatively, the secondary housing member 14 may be formed as a cone and slipped over the chute segment 12. Similarly, the secondary housing member 14 may have any number of shapes or configurations to present a representation of a recognizable object. The secondary housing 14 may be colored or imprinted with designs or indicia for improved aesthetics, representations of significance or advertising purposes, and is shown in FIG. 3 as being provided with horizontal stripes and window pane designs representing a lighthouse structure.

Figure 4:
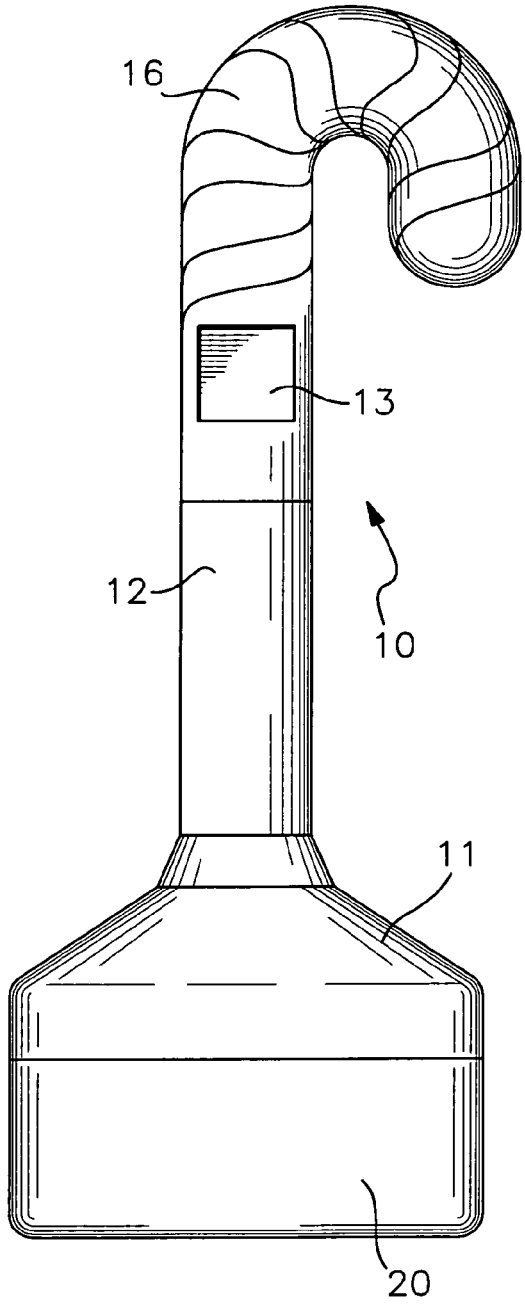
FIG. 4 shows a second embodiment of the invention, wherein the receiving tube member is provided with a detachable cap member.

FIG. 4 illustrates a second embodiment of the invention, wherein a cigarette butt receptacle device is comprised of a base member 20, a receiving tube member 10 and a detachable cap member 16. The base member 20 may be shorter in this embodiment, with the flared bottom 11 of the receiving tube member 10 being wider such that the junction is lower than in the traditional construction. The receiving tube member 10 may be a multi-component assembly, such that the chute segment 12 is detachable from the flared bottom 11, which facilitates storage and transport. The cap member 16 is connected to the chute segment 12 and contains the disposal openings 13. The cap member 16 may also be mounted above disposal openings 13 located on the chute segment 12. The cap member 16 may be permanently mounted to the chute segment 12, but is preferably removable and interchangeable, and is constructed to have improved aesthetics, representations of significance or advertising purposes. For example, as shown in FIG. 4, the cap member 16 is a representation of a candy cane designed to be displayed near the Christmas holidays. Other shapes, such as an egg, a firecracker, a turkey head, etc., could be interchanged for use during other holidays. Cap member 16 may also for example be provided with artificial foliage, such as tree branches or palm fronds, with advertising shapes or indicia, with other informational indicia, etc.

Figure 5:
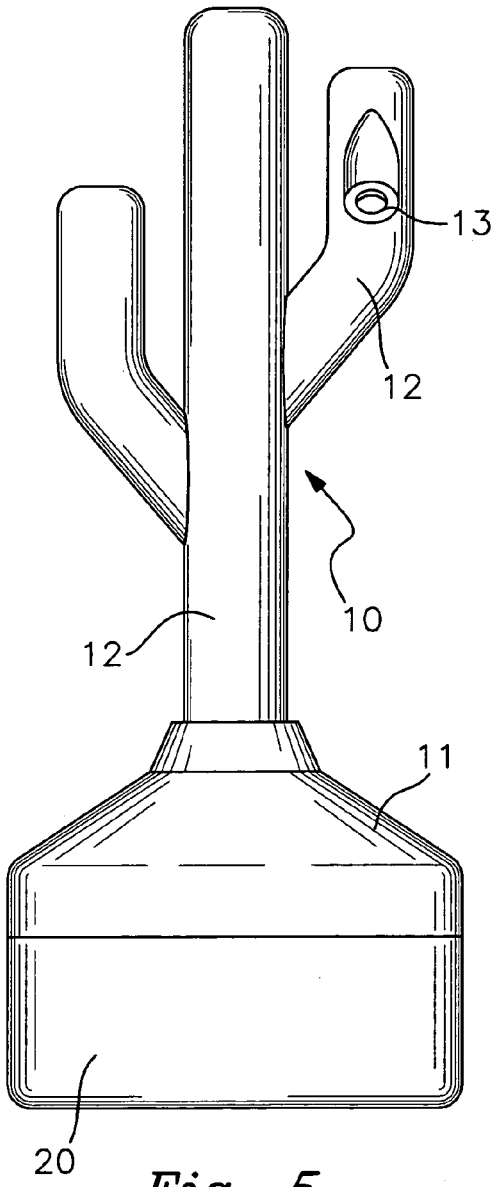
FIG. 5 shows a third embodiment of the invention, wherein the receiving tube member is non-linear, and the invention is configured as a cactus.

A third embodiment of the butt receptacle device is shown in FIG. 5, wherein the chute segment 12 of the receiving tube member 10 is non-linear, having in this embodiment relatively linear or curved segments joined by curved or angular joints between 90 and 180 degrees. The chute segment 12 continues to direct the disposed butts into the center of the base member 20 for capture by the container member 30, even though the disposal opening 13 is not aligned with the central vertical axis of the base member 20. In this embodiment the device is illustrated as a cactus.

Figure 6:
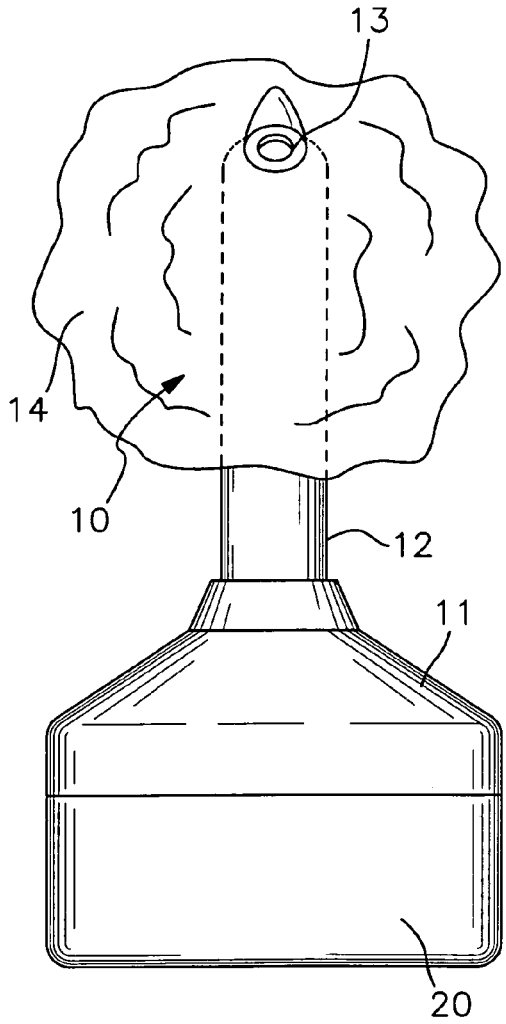
FIG. 6 shows a fourth embodiment of the invention, wherein the invention is configured as a shrub.

FIG. 6 shows a continuation of this theme, wherein the butt receptacle device comprises a secondary housing member 14 shaped as a shrub, thereby allowing the device to be less visually obtrusive. The lower portion of the chute segment 12 is adapted to represent the trunk of the shrub, such as by coloring it brown or providing bark-like indentions. Alternative constructions of this nature could include a statue, a beer bottle, a cigarette pack, etc. The secondary housing member 14 may be permanently or removably joined to the chute segment 12

Examples of device configurations include sports (baseball, football, soccer ball), national or country landmarks (Big Ben, Eiffel Tower, Empire State Building), animals, food and beverage (coke bottle, beer bottle, rolling pin), cigarette and cigar, branded products, weapons, company logos, sports team logos, trees or shrubs, statues, sports equipment, etc.

It is contemplated that equivalents and substitutions for certain elements set forth above may be obvious to those skilled in the art, and therefore the true scope and definition of the invention is to be as set forth in the following claims.

We claim:

1. A butt receptacle device comprising:

a base member;

a receiving tube member removably connected to said base member, said receiving tube member comprising a chute segment and at least one disposal opening to receive butts;

a butt container member disposed within said base member and below said chute segment; and a secondary housing member enclosing said chute segment of said receiving tube member.

2. The device of claim 1, wherein said secondary housing member is removably joined to said chute segment.

3. The device of claim 1, wherein said secondary housing member and said chute segment are integrally joined.

4. The device of claim 1, said secondary housing member being removably joined to said base member.

5. The device of claim 1, said receiving tube member further comprising a flared bottom, wherein said flared bottom is removably joined to said base member.

6. The device of claim 1, said secondary housing member having a configuration representational of a recognizable object.

7. The device of claim 1, said secondary housing bearing advertising indicia.

8. The device of claim 1, said secondary housing being in the shape of a plant.

9. A butt receptacle device comprising:

a base member;

a receiving tube member removably connected to said base member, said receiving tube member comprising a chute segment;

a butt container member disposed within said base member and below said chute segment;

at least one disposal opening to receive butts; and a cap member joined to said chute segment of said receiving tube member.

10. The device of claim 9, wherein said at least one disposal opening is located in said cap member.

11. The device of claim 9, wherein said at least one disposal opening is located in said chute segment.

12. The device of claim 9, wherein said cap member is removably joined to said chute segment.

13. The device of claim 9, said cap member having the representative configuration of a recognizable object.

14. The device of claim 9, said cap member having the representative configuration of foliage.

* * * * *